US006614187B1

(12) United States Patent
Kanzaki et al.

(10) Patent No.: US 6,614,187 B1
(45) Date of Patent: Sep. 2, 2003

(54) SHORT ARC TYPE MERCURY DISCHARGE LAMP WITH COIL DISTANCED FROM ELECTRODE

(75) Inventors: Yoshitaka Kanzaki, Himeji (JP); Takashi Yamashita, Takasago (JP); Toru Nishikubo, Himeji (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/946,671

(22) Filed: Sep. 6, 2001

(51) Int. Cl.[7] ..... H01J 17/04
(52) U.S. Cl. ..... 313/631; 313/571; 313/271
(58) Field of Search ..... 313/631, 632, 313/639, 640, 641, 571, 271, 273, 283

(56) References Cited

U.S. PATENT DOCUMENTS 4,052,634 A * 10/1977 De Kok ..... 313/630
4,101,799 A * 7/1978 Wiedijk et al. ..... 313/331
5,109,181 A * 4/1992 Fischer et al. ..... 313/571
5,357,167 A 10/1994 Mathews et al. ..... 313/632
5,497,049 A 3/1996 Fischer ..... 313/634
5,614,787 A * 3/1997 Kawai et al. ..... 313/623
5,742,123 A * 4/1998 Nagayama ..... 313/623
6,060,829 A * 5/2000 Kubon et al. ..... 313/631
6,200,918 B1 * 3/2001 Yanagitani et al. ..... 501/152

* cited by examiner

*Primary Examiner*—Vip Patel
*Assistant Examiner*—Kevin Quarterman
(74) *Attorney, Agent, or Firm*—Oblon, Spivak, McClelland, Maier & Neustadt, P.C.

(57) ABSTRACT

The present invention provides a short arc type mercury discharge lamp that, at lamp startup time, quickly shifts glow discharge to arc discharge, and quickly shifts the arc discharge position from the coil to the electrode tip, making it possible to maintain a stable discharge state, in the short arc type mercury discharge lamp 1, a coil 5 has been arranged on the side surface of an electrode 4, and 0.15 mg/mm$^3$ or more of mercury has been sealed inside a discharge vessel, wherein the side part 51 of the coil 5 close to the tip side of the electrode is constructed so as to be fixed to the side surface of the electrode 4, and, at least, the part 52 of the coil 5 following the side part 52 is distanced from the side surface of the electrode.

4 Claims, 3 Drawing Sheets

SHORT ARC TYPE MERCURY DISCHARGE LAMP WITH COIL DISTANCED FROM ELECTRODE

BACKGROUND OF THE INVENTION

1. Field of the Invention

The present invention relates to a short arc type discharge lamp which is used in the light source of a data projector and the like, and more particularly to an electrode structure of a short arc type mercury discharge lamp in which 0.15 mg/mm$^3$ or more of mercury is sealed inside a discharge vessel of the lamp, or an electrode structure of a short arc type mercury discharge lamp in which at least an emission metal and halogen are sealed inside a discharge vessel of the lamp.

2. Description of the Related Art

In the light source of a projector such as a data projector and the like, in addition to high illuminance and high color rendering, miniaturization thereof are desired. In order to meet these demands, a short arc type superhigh-pressure mercury lamp that has 0.15 mg/mm$^3$, or more, of mercury, or various emission metals and halogen sealed inside a discharge vessel of the lamp, is being employed.

Furthermore, here, a short arc type mercury discharge lamp means a mercury discharge lamp including a metal halide lamp and an ultrahigh-pressure mercury lamp, in which a coil that serves as the starting point of discharge at startup time is fixed on the lamp electrode so as to uniformly come into contact with the side surface of the electrode.

As for the startup of this kind of short arc type mercury discharge lamp, when the supply voltage is applied between the lamp electrodes, a glow discharge is started between one of the electrodes and a coil fixed to the side surface of the other electrode, and gradually shifts to an arc discharge. The heat of the coil heated by the discharge is transmitted to the electrode to which the coil is fixed, furthermore, this electrode is subjected to radiation heat due to the arc from the coil, which amounts to the state in which thermoelectrons are easily emitted. Furthermore, as the internal pressure of the lamp increases, the arc is narrowed down to be stable, and a stabilized arc discharge shifts to the tip of the electrode to generate a stationary lit up state of the lamp.

However, with the above-mentioned kind of short arc type mercury discharge lamp, the problem arises that the arc discharge commenced from the coil at startup time often becomes stabilized on the coil and does not shift to the tip of the electrode. This kind of phenomenon noticeably occurs when the tip of the coil is distanced from the tip of the electrode. This can be thought to occur because the heat produced due to the arc emitted by the coil, for example, escapes from the rear end part of the coil to the rear end part of the electrode which makes contact with the coil, and because thermal conduction to the tip of the electrode is not smoothly carried out, the occurrence of thermoelectron emission at the tip of the electrode becomes difficult and whereby the arc remains in the coil without being transferred to the tip of the electrode.

When this kind of abnormal discharge occurs, the arc contacts the outer wall of the lamp and troubles such as a lamp explosion, a cloudiness of the lamp, or a blackening of the lamp due to the vaporization of the tungsten coil due to abnormal heating of the coil occur. Furthermore, when glow discharge is continued for a long time, blackening of the lamp attendant upon the vaporization of the tungsten coil also occurs.

SUMMARY OF THE INVENTION

The present invention provides a short arc type mercury discharge lamp that, at lamp startup time, quickly shifts glow discharge to arc discharge, and quickly shifts the arc discharge position from the coil to the electrode tip, making it possible to maintain a stable discharge state. The short arc type mercury discharge lamp 1 is characterized in which a coil 5 has been arranged on the side surface of an electrode 4, and 0.15 mg/mm$^3$ or more of mercury has been sealed inside a discharge vessel, wherein the side part 51 of the coil 5 close to the tip side of the electrode is constructed so as to be fixed to the side surface of the electrode 4, and, at least, the part 52 of the coil 5 following the side part 52 is distanced from the side surface of the electrode.

With the foregoing problems in view, an object of the present invention is to provide a short arc type mercury discharge lamp that, at lamp startup time, quickly shifts glow discharge to arc discharge, and quickly shifts the arc discharge position from the coil to the tip of the electrode, making it possible to sustain a stable discharge.

In the present invention, the following kinds of means are used in order to solve the above-mentioned problems.

The first means is characterized in that, a short arc type mercury discharge lamp having a coil placed on the side surface of on o of the electrodes, and 0.15 mg/mm$^3$ or more of mercury hermetically enclosed in a discharge vessel, which is constituted so that the side part of the above-mentioned coil close to the tip side of the electrode is fixed to the side surface of the above-mentioned electrode, and, at least, the part of the coil following the side part of the coil is distanced from the side surface of the above-mentioned electrode.

The second means is characterized in that, in the above-mentioned first means, halogen is sealed in the discharge vessel.

The third means is characterized in that a short arc type mercury discharge lamp that has a coil arranged on the side surface of one of the electrodes, and, at least, emission metal and halogen sealed in a discharge vessel, which is constituted so that the side part of the above-mentioned coil is fixed to the side surface of the above-mentioned electrode, and, at least, the part of the coil following the side part of the coil is distanced from the side surface of the above-mentioned electrode.

The fourth means is characterized in that, in any one of the means, from the first means through the third means, the part of the coil close to the seal portion side of the above-mentioned electrode is constructed so as to be distanced from the side surface of the above-mentioned electrode.

EXPLANATION OF SYMBOLS

Figure 1:
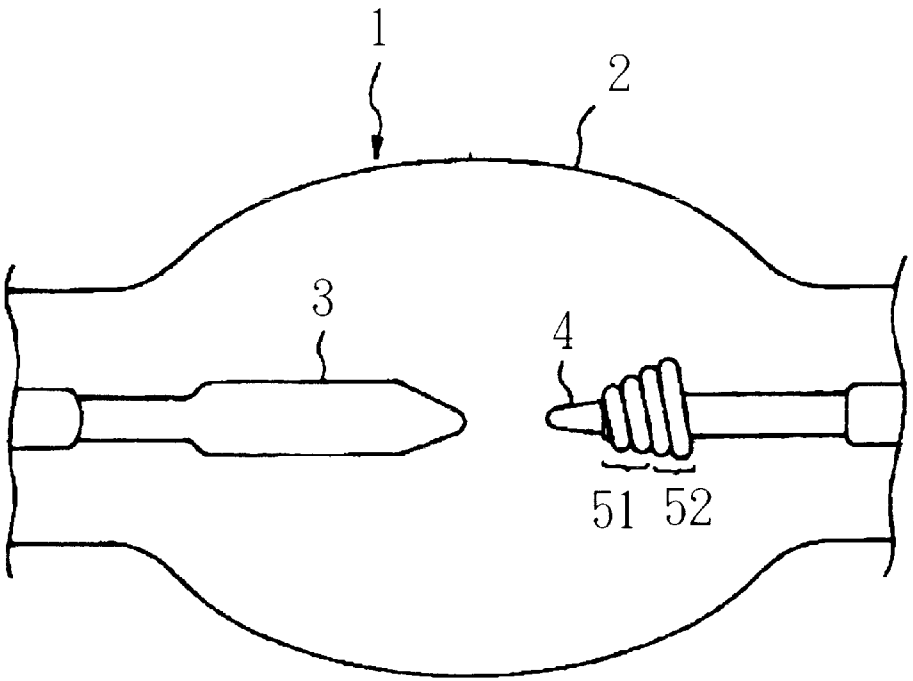
FIG. 1 is a partial external view of the short arc type mercury discharge lamp relating to the first embodiment of the present invention.

1 Short arc type mercury discharge lamp
2 Glass envelope
3, 4 Electrode

5 Coil
51 Side part of coil close to the tip side of electrode
52 Part of coil close to the seal portion side of electrode
6 Coil
61 Side part of coil close to the tip side of electrode
62 Intermediate part of coil
63 Part of coil close to the seal portion side of electrode

DESCRIPTION OF THE PREFERRED EMBODIMENTS

Figure 2:
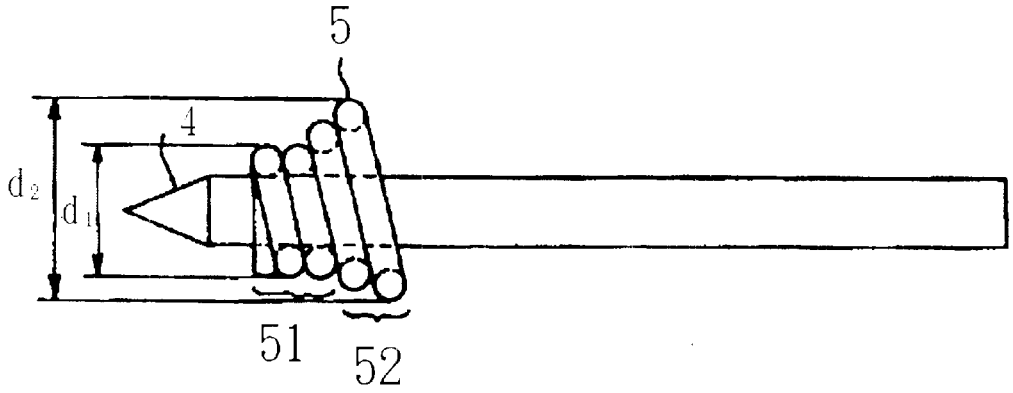
FIG. 2 is an enlarged view of the structure of one of the electrodes shown in FIG. 1.

The first embodiment of the present invention is explained using FIG. 1 and FIG. 2.

FIG. 1 is a partial external view of the short arc type mercury discharge lamp relating to this embodiment. FIG. 2 is an enlarged view of the structure of one of the electrodes shown in FIG. 1.

In these figures, 1 is a short arc type mercury discharge lamp, in which 0.15 mg/mm$^3$ or more of mercury, or various emission metals and halogen, have been sealed inside a discharge vessel of the lamp; 2 is a glass envelope; 3 and 4 are electrodes; 5 is a coil constituted so that the side part 51 of the coil close to the tip of the electrode 4 is fixed to the side surface of the electrode 4, and the part 52 of the coil following the above-mentioned fixed part is distanced from the side surface of the electrode 4.

Here, electrode 4, for example, is an electrode with a diameter $\phi$ of 0.8 mm. Furthermore, coil 5, for example, is a coil which is formed from tungsten, and in which the element wire diameter $\phi$ is 0.25 mm, the number of coil turns is four, the diameter $\phi$1 of the small diameter portion d1 fixed to the side surface of electrode 4 is 1.3 mm, and the diameter $\phi$2 of the large diameter portion d2 distanced from the side surface of electrode 4 is 1.5 mm.

Furthermore, as the methods of fixing the coil 5 to the electrode 4, the method such as a method based on caulking, a method comprising the step in which tungsten powder is dispersed on a coil 5 wrapped around the electrode 4 and sintered in a tungsten furnace, or a method based on melting and the like by electron beam and YAG laser can be used.

As mentioned above, in the embodiment of this invention, as shown in FIG. 1 and FIG. 2, the side part 51 of the coil 5 close to the tip side of the electrode is fixed to the side surface of the electrode 4 and the part 52 of the coil 5 close to the seal portion side of the electrode is distanced from the side surface of the electrode 4 to be formed in a state that the part is got out of contact with the electrode. For that reason, glow discharge commences between the electrode 3 and the above-mentioned parted part 52 of the coil 5, but, since this parted part 52 does not make contact with the electrode 4, the thermal capacity is small, and, for that reason, temperature rise at this part 52 can be quickly carried out, and thereby the startup of a short arc type mercury discharge lamp 1 can easily be caused to shift from glow discharge to arc discharge. Furthermore, since the side part 51 of the coil 5 close to the tip side of the electrode has been fixed, the heat of the coil 5 can be efficiently transmitted to the tip side of the electrode 4, the temperature rise of the electrode 4 also is quickly carried out, and the glow discharge commenced at the coil 5 can be smoothly caused to shift to arc discharge at the tip side of the electrode 4.

For that reason, according to the embodiment of this invention, at the startup time of a short arc type mercury discharge lamp, the blackening of the lamp discharge vessel due to continuous abnormal arc discharge at the coil and dying out of the arc can be prevented. Furthermore, since abnormal glow discharge also can be restrained, blackening of the lamp attributable to coil heating due to the abnormal glow discharge can be prevented, and the useful life of a lamp can be lengthened. Furthermore, defects such as lamp explosion and the lowering of discharge strength, due to the cloudiness of the discharge vessel, and furthermore, a lowering of optical characteristics and the occurrence of abnormal electrical characteristics of the lamp, due to the above-mentioned various types of abnormal discharge, can be prevented.

Figure 3:
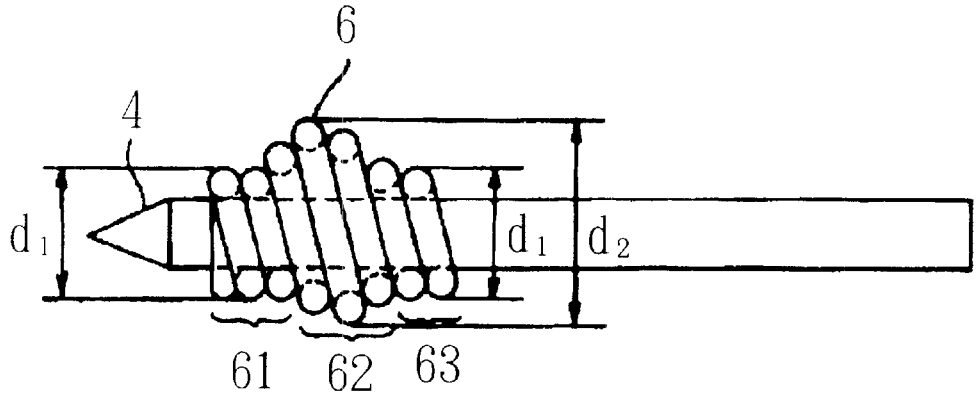
FIG. 3 is an enlarged view of an electrode structure having a coil shape different than the coil shape shown in FIG. 2 relating to the second embodiment of the present invention.

The second embodiment of the present invention is explained using FIG. 3.

FIG. 3 is an enlarged view of an electrode structure having a coil shape different than the coil shape shown in FIG. 2.

In this figure, 6 is a coil constructed so that the side part 61 near the tip of the electrode 4 is fixed to the side surface of the electrode 4, and the coil is distanced from the electrode at the intermediate part 62 following the above-mentioned fixed part and the part 63 of the coil close to the seal portion side 63 of the electrode 4 is fixed to the side surface of the electrode 4.

Here, coil 6 is a coil, for example, which is formed from tungsten, and in which the element wire diameter $\phi$ is 0.25 mm, the number of coil turns is seven, the diameter $\phi$ of the small diameter portion d1 fixed to the side surface of the electrode 4 is 1.3 mm, and the diameter $\phi$ of the large diameter portion d2 distanced from the side surface of the electrode 4 is 1.5 mm.

As mentioned above, in the embodiment of this invention, as shown in FIG. 3, the side part 61 of the coil 6 near the tip side of the electrode is fixed to the side surface of the electrode 4, and the intermediate part 62 of the coil 6 is distanced from the side surface of the electrode 4 to be formed in a state that the part is got out of contact with the electrode. For that reason, in the startup of a short arc type mercury discharge lamp 1, first of all, a glow discharge is commenced between the electrode 3 and the above-mentioned parted part 62 of the coil 6. Since the thermal capacity of this parted part 62 is small, the temperature of the part quickly rises, and the part can be easily made to shift from glow discharge to arc discharge. Since the side part 61 of the coil 6 close to the tip side of the electrode is fixed, the heat of the coil can be efficiently transmitted to the tip of the electrode 4, temperature also rises quickly and thereby grow discharge of the lamp can be smoothly shifted to arc discharge at the tip of the electrode 4.

Consequently, in this embodiment of the invention, in addition to the same kinds of effects as the first embodiment of the invention, since the part of the coil 6 closer to the seal portion side of the electrode 4 is also fixed to the side surface of the electrode 4, the effect that durable electrode structure is made due to both ends of the coil 6 fixed to the side surface of electrode 4 are exhibited.

According to the inventions described above, during the startup time, blackening of the lamp discharge vessel due to continuous abnormal arc discharge at the coil and dying out of the arc can be prevented. Furthermore, since abnormal glow discharge also can be restrained, blackening of the lamp due to coil heating at the time of abnormal glow discharge can be prevented, and the useful life of the lamp can be lengthened. Furthermore, troubles such as lamp explosion and the lowering of discharge strength due to the cloudiness of the discharge vessel due to the above-mentioned various types of abnormal discharge, and furthermore, a lowering of optical characteristics and the occurrence of abnormal electrical characteristics of the lamp, can be prevented.

What is claimed is:

1. A short arc type mercury discharge lamp having:

a coil arranged on the side surface of one of electrodes; and 0.15 mg/mm$^3$ or more of mercury sealed inside a discharge vessel, wherein the side part of the coil close to the tip side of the electrode is fixed to the side surface of said electrode for commencing glow discharge; and, at least, the part of the coil following the side part of said coil is constructed so as to be distanced from the side surface of said electrode.

2. The short arc type mercury discharge lamp according to claim 1, wherein halogen is sealed in the discharge vessel.

3. A short arc type mercury discharge lamp having:

a coil arranged on a side surface of one of electrodes; and, at least, an emission metal and halogen sealed inside a discharge vessel, wherein the side part of the coil close to the tip side of the electrode is fixed to the side surface of said electrode for commencing glow discharge; and, at least, the part of the coil following the side part of said coil is constructed so as to be distanced from the side surface of said electrode.

4. The short arc type mercury discharge lamp according to any one of claim 1 through claim 3, wherein the part of the coil close to the seal portion side of said electrode is constructed so as to be distanced from the side surface of said electrode.

* * * * *